US007287503B2

(12) United States Patent
Suzuki

(10) Patent No.: US 7,287,503 B2
(45) Date of Patent: Oct. 30, 2007

(54) ENGINE AIR INTAKE APPARATUS

(75) Inventor: Mikihiko Suzuki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 120 days.

(21) Appl. No.: 11/318,551

(22) Filed: Dec. 28, 2005

(65) Prior Publication Data

US 2007/0017471 A1 Jan. 25, 2007

(30) Foreign Application Priority Data

Jul. 25, 2005 (JP) ..... 2005-214036

(51) Int. Cl.
*F02M 35/10* (2006.01)

(52) U.S. Cl. ..... 123/184.53; 55/385.3; 55/DIG. 21; 181/229

(58) Field of Classification Search ..... 123/184.53, 123/198 E; 55/385.3, DIG. 21; 181/229
See application file for complete search history.

(56) References Cited

U.S. PATENT DOCUMENTS 6,332,442 B1 * 12/2001 Komada et al. ..... 123/184.55

FOREIGN PATENT DOCUMENTS

| | | |
|---|---|---|
| JP | 63-60072 U | 4/1988 |
| JP | 02-26758 U | 2/1990 |
| JP | 07-027028 A | 1/1995 |

* cited by examiner

*Primary Examiner*—Noah P. Kamen
(74) *Attorney, Agent, or Firm*—Sughrue Mion, PLLC

(57) ABSTRACT

An air cleaner chamber is configured such that a filtering member is held between an air cleaner cover and an air cleaner case. A low-speed operation air intake passage and a high-speed operation air intake passage share an outlet passage portion near a dusty space, and are molded integrally on the air cleaner case using a synthetic resin. A passage switching valve is disposed so as to switch an aperture area of the high-speed operation air intake passage. In addition, a valve actuator for driving the passage switching valve is mounted to the air cleaner case.

7 Claims, 9 Drawing Sheets

ENGINE AIR INTAKE APPARATUS

BACKGROUND OF THE INVENTION

1. Field of the Invention

The present invention relates to an engine air intake apparatus and particularly to an air intake apparatus in which an air intake passage is configured integrally on an air cleaner.

2. Description of the Related Art

In passenger car engines, air intake noise emitted from air intake passage inlet portions accounts for a large share of overall noise during slow running when noise resulting from mechanical operation and vibration of the engine itself, exhaust noise, etc., are comparatively small. Thus, one important task has been to reduce the air intake noise during slow running while ensuring sufficient intake air flow required during high-speed operation to avoid reductions in engine power.

In view of these conditions, in some conventional engine air intake apparatuses, air suction portions are constituted by: a normally-open suction port having an aperture area that is constant; and a variable suction port having an aperture area that changes, and the aperture area of the variable suction port is changed depending on the rotational frequency of the engine so as to be increased when the engine is in a high rotational frequency range and reduced or closed in a normal rotational frequency range. (See Patent Literature 1, for example.)

Other conventional engine air intake apparatuses include: a first duct having one end open to atmospheric air, including a flow control portion that is closed at low rotational frequencies, and opened at high rotational frequencies; and a second duct open to atmospheric air that is longer than the first duct. (See Patent Literature 2, for example.)

Patent Literature 1: Japanese Utility Model Laid-Open No. SHO 63-60072 (Gazette)

Patent Literature 2: Japanese Patent Laid-Open No. HEI 07-27028 (Gazette)

Because these conventional engine air intake apparatuses include two independent passages constituted by a normally-open air intake passage and an air intake passage having a changing aperture area, the size of the air intake apparatuses is increased. Thus, some problems have been that demand for reductions in mounting space for the air intake apparatus inside engine compartments accompanying demands for increased auxiliary machinery and reductions in size and weight cannot be met, and the weight of parts is increased.

SUMMARY OF THE INVENTION

The present invention aims to solve the above problems and an object of the present invention is to provide a compact, light-weight engine air intake apparatus enabling engine output during high-speed operation to be improved and also enabling air intake noise during low-speed operation to be reduced by enabling sharing of a passage portion among a plurality of air intake passages.

In order to achieve the above object, according to one aspect of the present invention, there is provided an engine air intake apparatus including: a plurality of air intake passages molded integrally on a synthetic resin air cleaner case of an engine air cleaner; a passage switching valve disposed on the air cleaner case, the passage switching valve switching among the plurality of air intake passages; and a valve actuator for driving the passage switching valve. Each air intake passage of the plurality of air intake passages is formed so as to have a passage portion shared with at least one other of the air intake passages. The valve actuator drives the passage switching valve so as to selectively switch among the plurality of air intake passages so as to configure an air intake pathway corresponding to an engine operating state.

According to the present invention, because each of the air intake passages has a passage portion shared with another air intake passage, size reductions and weight reductions are enabled compared to when a plurality of air intake passages are formed independently. With the size reductions and the weight reductions, material costs can be reduced, enabling price reductions to be achieved.

The valve actuator drives the passage switching valve so as to selectively switch among the plurality of air intake passages so as to configure an intake pathway corresponding to an engine operating state. Thus, by enlarging an aperture area of an air intake pathway during high-speed operation and reducing the aperture area of the air intake pathway during low-speed operation, engine output during high-speed operation can be improved and air intake noise during low-speed operation can be reduced.

DETAILED DESCRIPTION OF THE PREFERRED EMBODIMENTS

Preferred embodiments of the present invention will now be explained with reference to the drawings.

Embodiment 1

Figure 1:
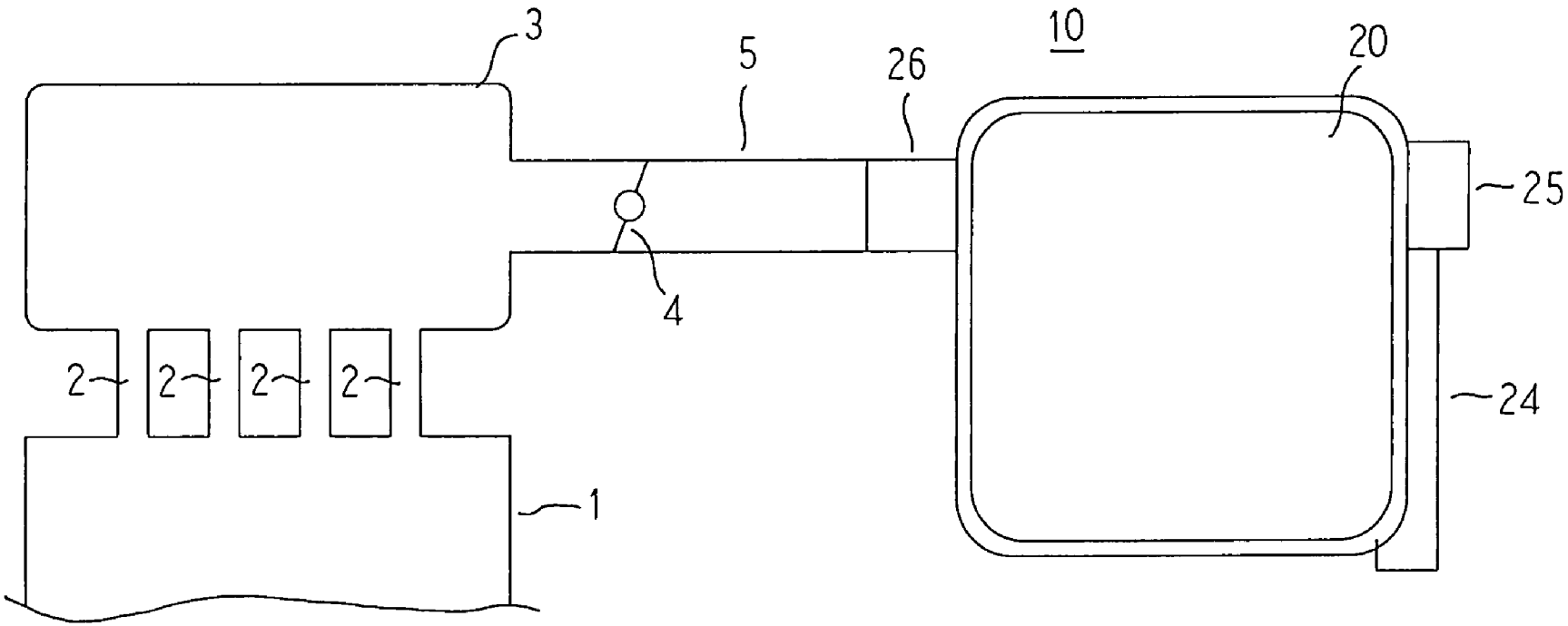
FIG. 1 is a system configuration diagram employing an engine air intake apparatus according to Embodiment 1 of the present invention.
Figure 2:
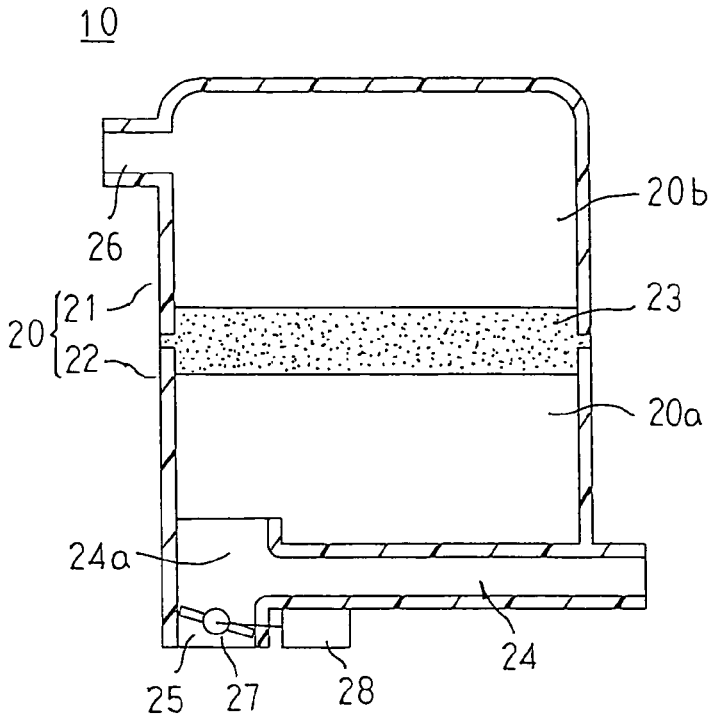
FIG. 2 is a cross section showing a state during low-speed operation in the engine air intake apparatus according to Embodiment 1 of the present invention.
Figure 3:
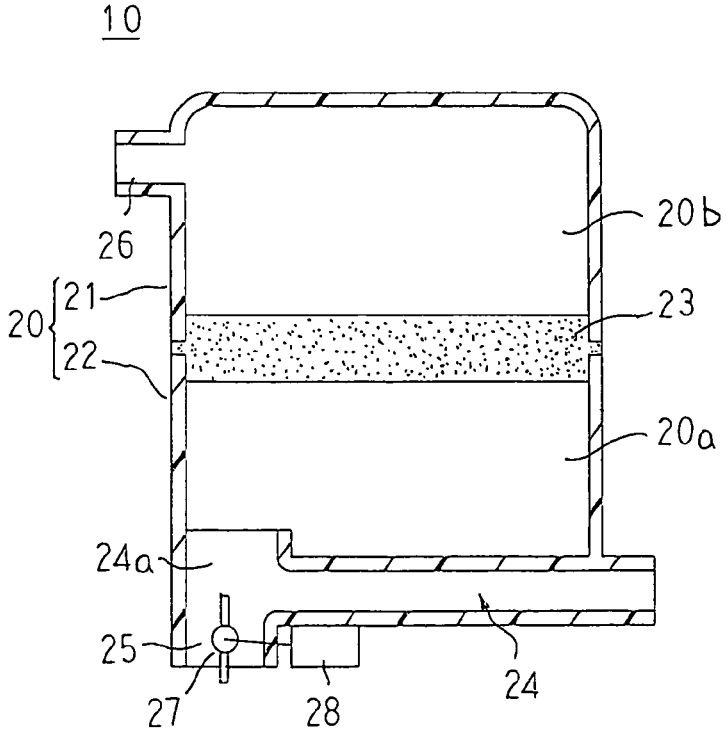
FIG. 3 is a cross section showing a state during high-speed operation in the engine air intake apparatus according to Embodiment 1 of the present invention.

FIG. 1 is a system configuration diagram employing an engine air intake apparatus according to Embodiment 1 of the present invention, FIG. 2 is a cross section showing a state during low-speed operation in the engine air intake apparatus according to Embodiment 1 of the present invention, and FIG. 3 is a cross section showing a state during high-speed operation in the engine air intake apparatus according to Embodiment 1 of the present invention.

In FIG. 1, an air intake pipe 5 is connected to a downstream passage 26 of an air intake apparatus 10, and a throttle valve 4 is disposed inside the air intake pipe 5. The air intake pipe 5 is linked to a surge tank 3 at a downstream end. In addition, the surge tank 3 is linked to respective cylinders of an engine 1 by means of an intake manifold 2.

Next, a specific configuration of the air intake apparatus 10 will be explained with reference to FIGS. 2 and 3.

The air intake apparatus 10 includes: an air cleaner chamber 20; a filtering member 23 disposed so as to separate an internal portion of the air cleaner chamber 20 into a dusty space 20*a* and a clean space 20*b*; a low-speed operation air intake passage 24 formed so as to communicate between the dusty space 20*a* of the air cleaner chamber 20 and an external portion; a high-speed operation air intake passage 25 formed so as to communicate between the dusty space 20*a* of the air cleaner chamber 20 and an external portion; and a downstream passage 26 formed so as to communicate between the clean space 20*b* of the air cleaner chamber 20 and an external portion. The high-speed operation air intake passage 25 is configured so as to communicate between an outlet passage portion 24*a* of the low-speed operation air intake passage 24 near the dusty space 20*a* and the external portion. In addition, a passage switching valve 27 is disposed in an inlet portion of the high-speed operation air intake passage 25. A valve actuator 28 drives the passage switching valve 27 in accordance with control signals from an engine control apparatus (ECU) (not shown) such that an aperture area of the high-speed operation air intake passage 25 is made variable.

Here, the air cleaner chamber 20, which functions as an air cleaner, is configured by disposing the filtering member 23 in a space surrounded by an air cleaner cover 21 made of a synthetic resin and an air cleaner case 22 made of a synthetic resin. The high-speed operation air intake passage 25 and the low-speed operation air intake passage 24 are molded integrally on the air cleaner case 22 such that the two passages share an outlet passage portion near the dusty space 20*a*, and the downstream passage 26 is molded integrally on the air cleaner cover 21. A passage cross-sectional area and a passage length of the low-speed operation air intake passage 24 are set to appropriate values so as to correspond to specifications of the engine 1 to which it is applied with consideration for pulsation effects in the intake air such that engine intake air flow increases in a low-speed operating range and output torque is improved by increasing volumetric efficiency.

Moreover, examples of materials that can be used for the air cleaner cover 21 and the air cleaner case 22 include, for example, synthetic resins such as polypropylene resins, polyamide resins, etc. In addition, such synthetic resins may also be reinforced by glass fibers, talc, etc.

In an air intake apparatus 10 configured in this manner, during low-speed operation of the engine 1, the valve actuator 28 drives the passage switching valve 27 in accordance with a control signal from the engine control apparatus so as to block the high-speed operation air intake passage 25. Thus, air is sucked through the low-speed operation air intake passage 24 into the dusty space 20*a*, flows through the filtering member 23 into the clean space 20*b*, flows through the downstream passage 26 into the air intake pipe 5, and is supplied to the engine 1. Thus, since the high-speed operation air intake passage 25 is closed and air is sucked inside only through the low-speed operation air intake passage 24 during low-speed operation of the engine 1, air intake noise is reduced and output torque during low-speed operation is improved because the aperture area is kept to a minimum.

During high-speed operation of the engine 1, the valve actuator 28 drives the passage switching valve 27 in accordance with a control signal from the engine control apparatus so as to open the high-speed operation air intake passage 25. Thus, air is sucked through both the low-speed operation air intake passage 24 and the high-speed operation air intake passage 25 into the dusty space 20*a*, flows through the filtering member 23 into the clean space 20*b*, flows through the downstream passage 26 into the air intake pipe 5, and is supplied to the engine 1. Thus, since air is sucked inside through both the low-speed operation air intake passage 24 and the high-speed operation air intake passage 25 during high-speed operation of the engine 1, aperture area is increased, enabling exactly the amount of air required by the engine 1 to be supplied to the engine 1, thereby improving output torque.

Consequently, because the air intake apparatus 10 configures an air intake pathway in response to the operating state of the engine 1 by using the valve actuator 28 to drive the passage switching valve 27 so as to selectively switch between the low-speed operation air intake passage 24 and the high-speed operation air intake passage 25, air intake noise during low-speed operation can be reduced without giving rise to reductions in engine output during high-speed operation.

The high-speed operation air intake passage 25 is configured so as to communicate between an outlet passage portion 24*a* of the low-speed operation air intake passage 24 near the dusty space 20*a* and the external portion. In other words, the high-speed operation air intake passage 25 and the low-speed operation air intake passage 24 are designed to share the outlet passage portion 24*a* near the dusty space 20*a*. Thus, reductions in the size and weight of the air intake apparatus are enabled compared to when a high-speed operation air intake passage and a low-speed operation air intake passage are formed as independent air intake passages. With reductions in the size and weight of the air intake apparatus, reductions in material costs are enabled, enabling reductions in the price of the air intake apparatus to be achieved.

Because the low-speed operation air intake passage 24 and the high-speed operation air intake passage 25 are molded integrally on the air cleaner case 22 using a synthetic resin, operations for mounting the low-speed operation air intake passage 24 and the high-speed operation air intake passage 25 are also no longer necessary, enabling price reductions to be enabled.

Embodiment 2

Figure 4:
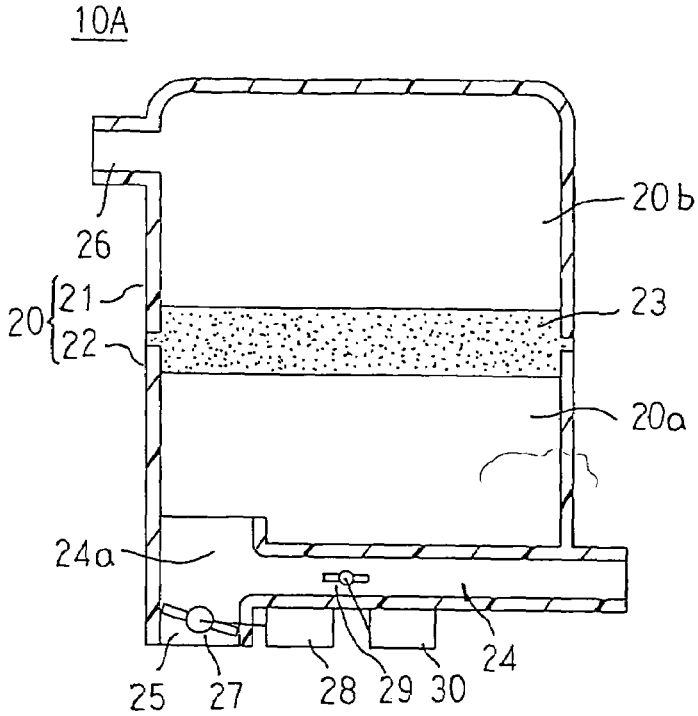
FIG. 4 is a cross section showing a state during low-speed operation in an engine air intake apparatus according to Embodiment 2 of the present invention.
Figure 5:
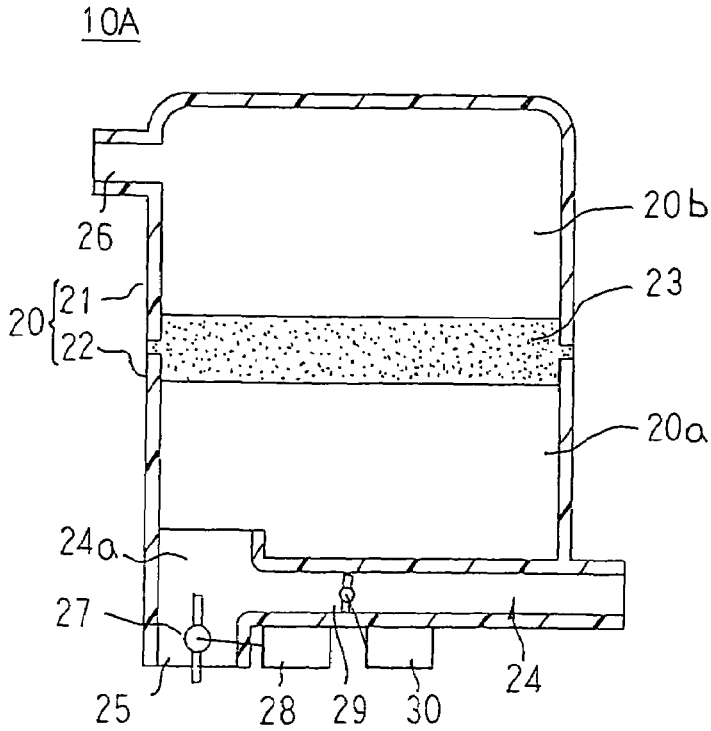
FIG. 5 is a cross section showing a state during high-speed operation in the engine air intake apparatus according to Embodiment 2 of the present invention.

FIG. 4 is a cross section showing a state during low-speed operation in an engine air intake apparatus according to Embodiment 2 of the present invention, and FIG. 5 is a cross section showing a state during high-speed operation in the engine air intake apparatus according to Embodiment 2 of the present invention.

In FIGS. 4 and 5, a passage switching valve 29 is disposed in the low-speed operation air intake passage 24. A valve actuator 30 drives the passage switching valve 29 in accordance with control signals from an engine control apparatus (ECU) (not shown) such that an aperture area of the low-speed operation air intake passage 24 is made variable. A passage cross-sectional area and a passage length of the high-speed operation air intake passage 25 are set to appropriate values with consideration for pulsation effects in the intake air in a similar manner to the low-speed operation air intake passage 24 such that engine intake air flow increases in a prescribed high-speed operating range and output torque is improved by increasing volumetric efficiency.

Moreover, the rest of this embodiment is configured in a similar manner to Embodiment 1 above.

In an air intake apparatus 10A configured in this manner, during low-speed operation of the engine 1, the valve actuator 28 drives the passage switching valve 27 so as to block the high-speed operation air intake passage 25 and the valve actuator 30 drives the passage switching valve 29 so as to open the low-speed operation air intake passage 24, in accordance with control signals from the engine control apparatus. Thus, air is sucked through the low-speed operation air intake passage 24 into the dusty space 20*a*, flows through the filtering member 23 into the clean space 20*b*, flows through the downstream passage 26 into the air intake pipe 5, and is supplied to the engine 1. Thus, since the high-speed operation air intake passage 25 is closed and air is sucked inside only through the low-speed operation air intake passage 24 during low-speed operation of the engine 1, air intake noise is reduced and output torque during low-speed operation is improved because the aperture area is kept to a minimum.

During high-speed operation of the engine 1, the valve actuator 28 drives the passage switching valve 27 so as to open the high-speed operation air intake passage 25 and the valve actuator 30 drives the passage switching valve 29 so as to block the low-speed operation air intake passage 24, in accordance with control signals from the engine control apparatus. Thus, air is sucked only through the high-speed operation air intake passage 25 into the dusty space 20*a*, flows through the filtering member 23 into the clean space 20*b*, flows through the downstream passage 26 into the air intake pipe 5, and is supplied to the engine 1. Thus, since air is sucked inside through the high-speed operation air intake passage 25 during high-speed operation of the engine 1, aperture area is increased, enabling exactly the amount of air required by the engine 1 to be supplied to the engine 1, thereby improving output torque in a prescribed high-speed operating range.

The high-speed operation air intake passage 25 is configured so as to communicate between an outlet passage portion 24*a* of the low-speed operation air intake passage 24 near the dusty space 20*a* and the external portion. In other words, the high-speed operation air intake passage 25 and the low-speed operation air intake passage 24 are designed to share the outlet passage portion 24*a* near the dusty space 20*a*.

Consequently, similar effects to those in Embodiment 1 above can also be achieved in Embodiment 2.

Moreover, in Embodiment 2 above, the low-speed operation air intake passage 24 is explained as being blocked during high-speed operation, but air may also be sucked inside through both the high-speed operation air intake passage 25 and the low-speed operation air intake passage 24.

In Embodiment 2 above, two passage switching valves 27 and 29 are explained as being driven by two valve actuators 28 and 30, but the opening and closing actions of the two passage switching valve 27 and 29 may also be made interdependent and driven by a single valve actuator.

Embodiment 3

Figure 6:
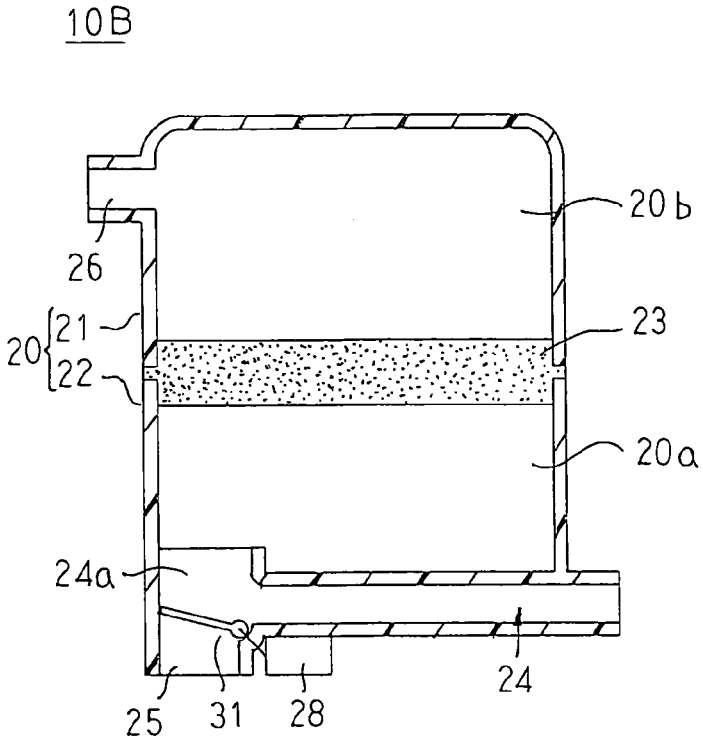
FIG. 6 is a cross section showing a state during low-speed operation in an engine air intake apparatus according to Embodiment 3 of the present invention.
Figure 7:
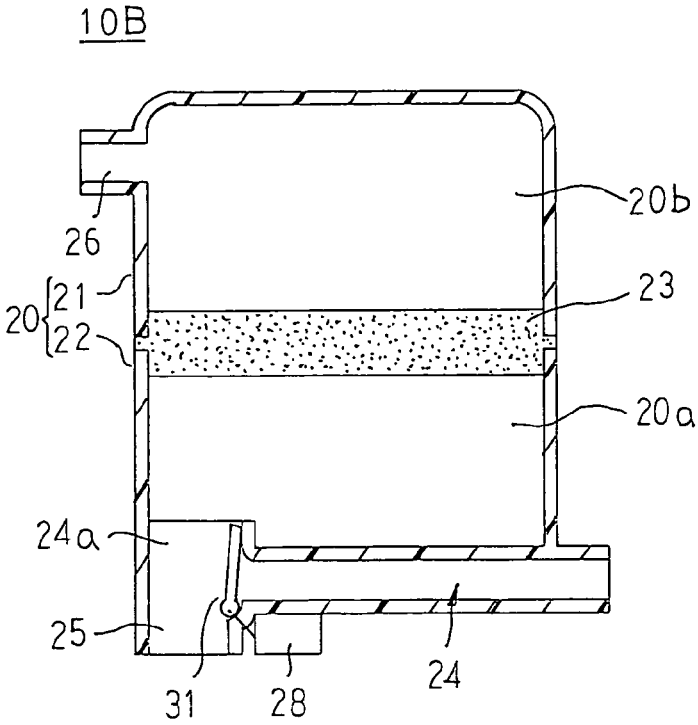
FIG. 7 is a cross section showing a state during high-speed operation in the engine air intake apparatus according to Embodiment 3 of the present invention.

FIG. 6 is a cross section showing a state during low-speed operation in an engine air intake apparatus according to Embodiment 3 of the present invention, and FIG. 7 is a cross section showing a state during high-speed operation in the engine air intake apparatus according to Embodiment 3 of the present invention.

In FIGS. 6 and 7, a passage switching valve 31 is a flap valve, and is disposed so as to adopt a state blocking a high-speed operation air intake passage 25 and a state blocking a low-speed operation air intake passage 24. A valve actuator 28 drives the passage switching valve 31 in accordance with control signals from an engine control apparatus (ECU) (not shown) so as to adopt the state blocking the high-speed operation air intake passage 25 and the state blocking the low-speed operation air intake passage 24.

Moreover, the rest of this embodiment is configured in a similar manner to Embodiment 2 above.

In an air intake apparatus 10B configured in this manner, during low-speed operation of the engine 1, the valve actuator 28 drives the passage switching valve 31 so as to block the high-speed operation air intake passage 25 and open the low-speed operation air intake passage 24, in accordance with control signals from the engine control apparatus. Thus, air is sucked through the low-speed operation air intake passage 24 into the dusty space 20*a*, flows through the filtering member 23 into the clean space 20*b*, flows through the downstream passage 26 into the air intake pipe 5, and is supplied to the engine 1. Thus, since air is sucked inside only through the low-speed operation air intake passage 24 during low-speed operation of the engine 1, air intake noise is reduced and output torque during low-speed operation is improved because the aperture area is kept to a minimum.

During high-speed operation of the engine 1, the valve actuator 28 drives the passage switching valve 31 so as to open the high-speed operation air intake passage 25 and block the low-speed operation air intake passage 24, in accordance with control signals from the engine control apparatus. Thus, air is sucked only through the high-speed operation air intake passage 25 into the dusty space 20*a*, flows through the filtering member 23 into the clean space 20*b*, flows through the downstream passage 26 into the air intake pipe 5, and is supplied to the engine 1. Thus, since air is sucked inside through the high-speed operation air intake passage 25 during high-speed operation of the engine 1, aperture area is increased, enabling exactly the amount of air required by the engine 1 to be supplied to the engine 1, thereby improving output torque in a prescribed high-speed operating range.

The high-speed operation air intake passage 25 is configured so as to communicate between an outlet passage portion 24*a* of the low-speed operation air intake passage 24 near the dusty space 20*a* and the external portion. In other words, the high-speed operation air intake passage 25 and the low-speed operation air intake passage 24 are designed to share the outlet passage portion 24*a* near the dusty space 20*a*.

Consequently, similar effects to those in Embodiment 2 above can also be achieved in Embodiment 3.

A flap valve is used for the passage switching valve 31, and is made to adopt a state blocking a high-speed operation air intake passage 25 and a state blocking a low-speed operation air intake passage 24. Thus, because a single passage switching valve 31 and a single valve actuator 28 are used such that air is sucked inside only through the high-speed operation air intake passage 25 during high-speed operation and only through the low-speed operation air intake passage 24 during low-speed operation, configuration of the air intake apparatus is simplified compared to Embodiment 2 above, enabling further price reductions.

Embodiment 4

Figure 8:
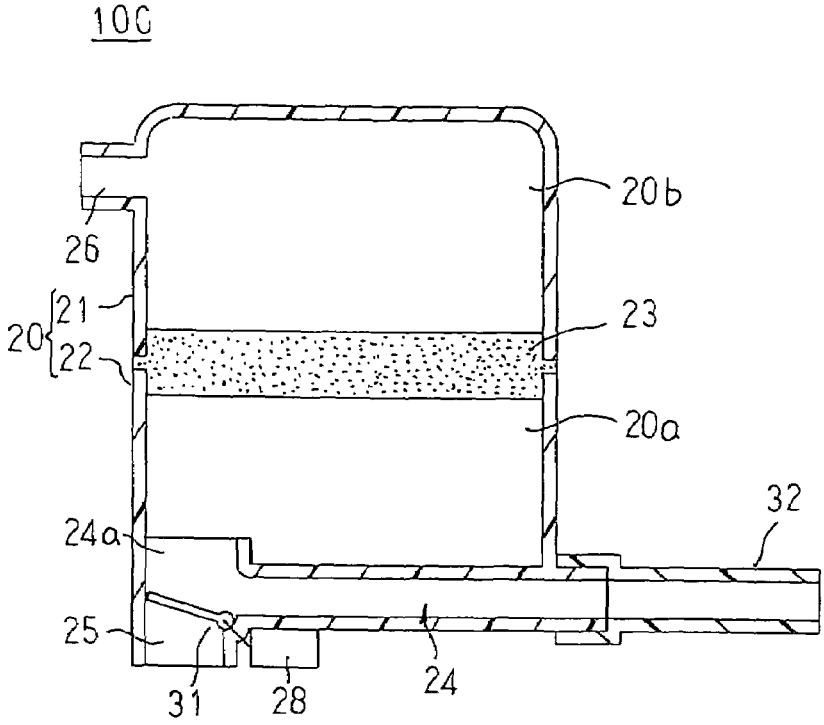
FIG. 8 is a cross section showing an engine air intake apparatus according to Embodiment 4 of the present invention.

FIG. 8 is a cross section showing an engine air intake apparatus according to Embodiment 4 of the present invention.

In FIG. 8, an air intake apparatus 10C is configured such that an air intake duct 32 is fitted onto an intake air upstream end of a low-speed operation air intake passage 24.

Moreover, the rest of this embodiment is configured in a similar manner to Embodiment 3 above.

In Embodiment 4, because the air intake duct 32 is fitted onto the intake air upstream end of the low-speed operation air intake passage 24, the length of the low-speed operation air intake passage can be adjusted to an appropriate value so as to correspond to specifications of an engine 1 and air intake apparatus mounting constraints by adjusting the length of the air intake duct 32.

Moreover, in Embodiment 4 above, the air intake duct 32 is explained as being mounted to the intake air upstream end of the low-speed operation air intake passage 24, but an air intake duct 32 may instead be mounted to an intake air upstream end of the high-speed operation air intake passage 25. Furthermore, air intake ducts 32 may also be mounted to the intake air upstream ends of both the high-speed operation air intake passage 25 and the low-speed operation air intake passage 24.

Embodiment 5

Figure 9:
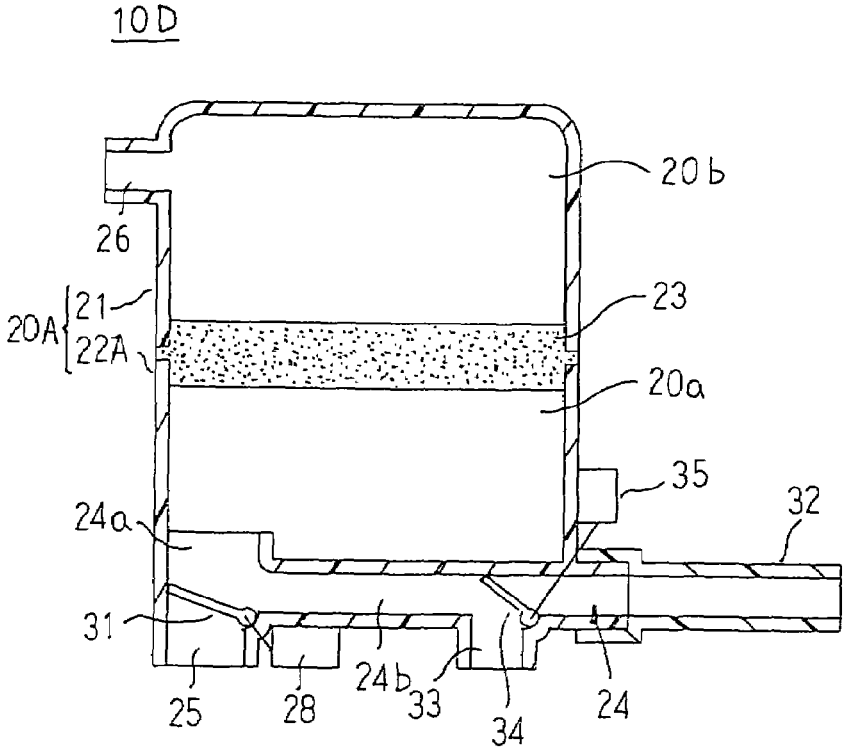
FIG. 9 is a cross section showing an engine air intake apparatus according to Embodiment 5 of the present invention.

FIG. 9 is a cross section showing an engine air intake apparatus according to Embodiment 5 of the present invention.

In FIG. 9, an air cleaner chamber 20A is constituted by an air cleaner cover 21 and an air cleaner case 22A. In addition to a high-speed operation air intake passage 25, a medium-speed operation air intake passage 33 is formed on the air cleaner case 22A so as to communicate between a passage portion partway along a pathway of a low-speed operation air intake passage 24 and an external portion. A passage switching valve 34 constituted by a flap valve is disposed so as to adopt a state blocking the medium-speed operation air intake passage 33 and a state blocking the low-speed operation air intake passage 24. In addition, a valve actuator 35 drives the passage switching valve 34 in accordance with control signals from an engine control apparatus (ECU) (not shown) so as to adopt the state blocking the medium-speed operation air intake passage 33 and the state blocking the low-speed operation air intake passage 24. Here, the passage cross-sectional area of the high-speed operation air intake passage 25 is greater than that of the medium-speed operation air intake passage 33, and the passage cross-sectional area of the medium-speed operation air intake passage 33 is greater than that of the low-speed operation air intake passage 24.

Moreover, the rest of this embodiment is configured in a similar manner to Embodiment 4 above.

In an air intake apparatus 10D configured in this manner, three kinds of air intake pathway each having a different passage length and passage cross-sectional area can be selectively switched using the passage switching valves 31 and 34.

Thus, because an appropriate passage length and passage cross-sectional area can be selected in response to the operating state by controlling driving of the valve actuators 28 and 35 using the engine control apparatus, output torque from the engine 1 can be improved, and air intake noise can also be reduced.

When the passage switching valves 34 blocks the low-speed operation air intake passage 24, air is sucked inside through the medium-speed operation air intake passage 33, flows through a passage portion 24*b* of the low-speed operation air intake passage 24 downstream from the passage switching valve 34, also flows through the outlet passage portion 24*a* of the low-speed operation air intake passage 24 near a dusty space 20*a*, and flows into the dusty space 20*a*. In other words, the medium-speed operation air intake passage 33 shares portions (24*a* and 24*b*) of the low-speed operation air intake passage 24. Thus, in Embodiment 5 reductions in the size and weight of the air intake apparatus are also enabled compared to when a high-speed operation air intake passage, a medium-speed operation air intake passage, and a low-speed operation air intake passage are formed as independent air intake passages.

Because the high-speed operation air intake passage 25 and the medium-speed operation air intake passage 33 share a portion (24*a*) of the low-speed operation air intake passage 24, further reductions in the size and weight of the intake apparatus are enabled.

Moreover, in Embodiment 5 above, three air intake passages, i.e., the high-speed operation air intake passage 25, the medium-speed operation air intake passage 33, and the low-speed operation air intake passage 24, are configured by branching the medium-speed operation air intake passage 33 off from the low-speed operation air intake passage 24, but four or more air intake passages may also be configured by increasing the number of branches in the air intake passages. A passage switching valve may also be disposed at each of the branching air intake passages. Here, a plurality of passage switching valves may also be driven by a single valve actuator so as to open and close interdependently. Moreover, in that case, each of the four or more air intake passages can also be formed so as to have a passage portion shared with at least one other air intake passage.

Embodiment 6

Figure 10:
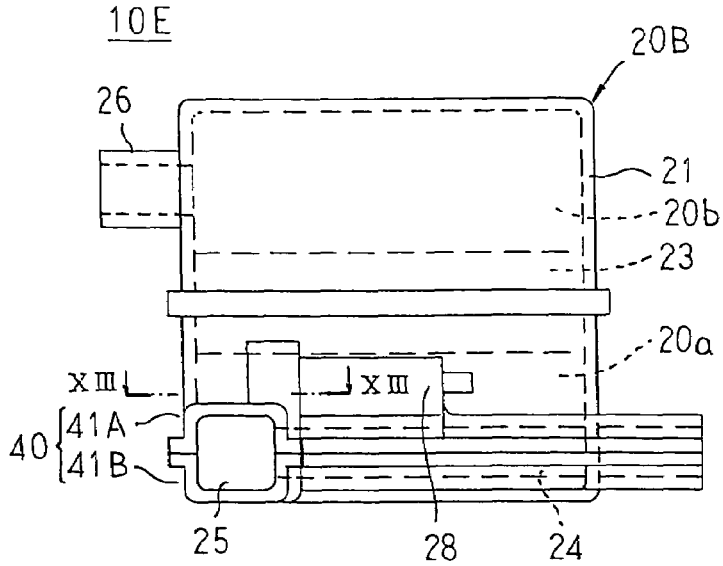
FIG. 10 is a front elevation showing an engine air intake apparatus according to Embodiment 6 of the present invention.
Figure 11:
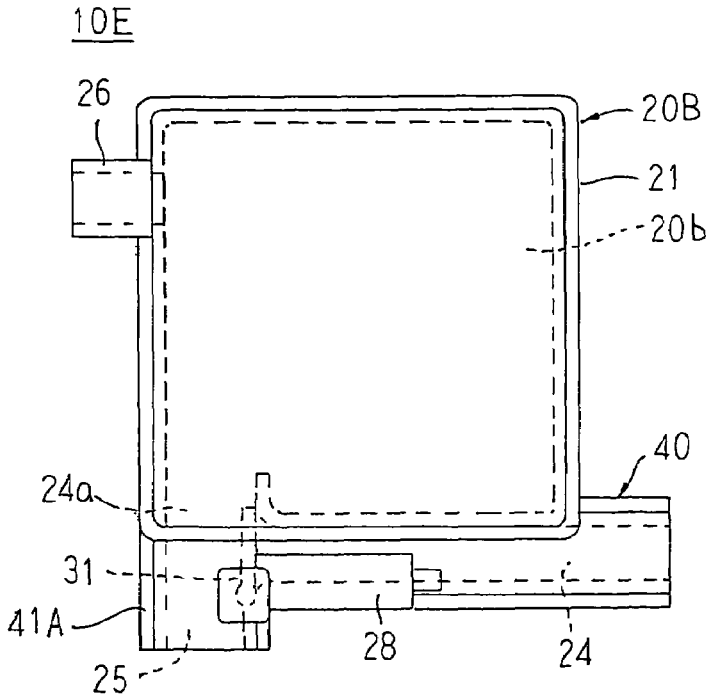
FIG. 11 is a top plan showing the engine air intake apparatus according to Embodiment 6 of the present invention.
Figure 12:
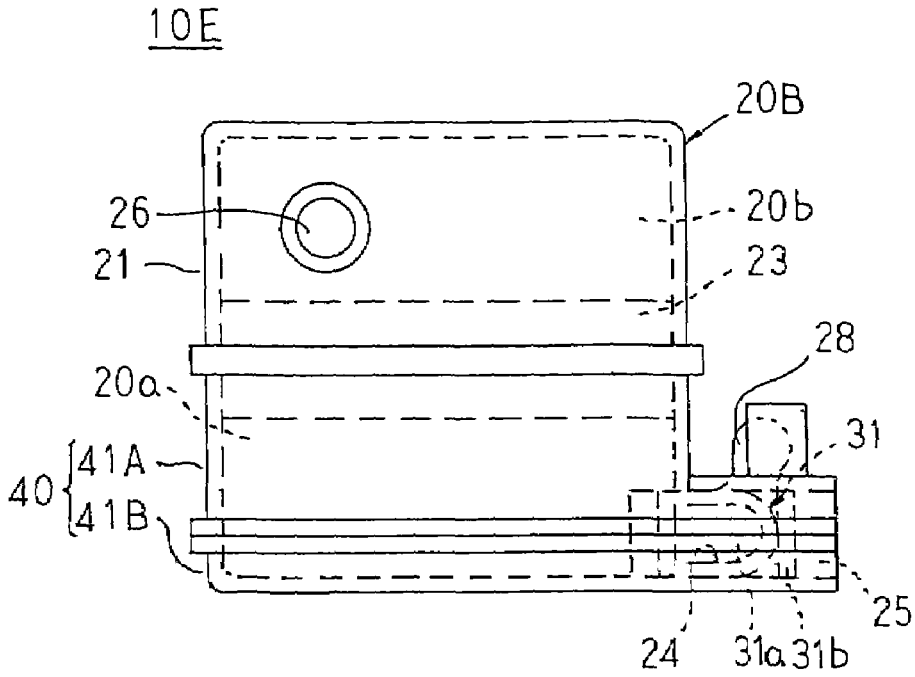
FIG. 12 is a side elevation showing the engine air intake apparatus according to Embodiment 6 of the present invention.
Figure 13:
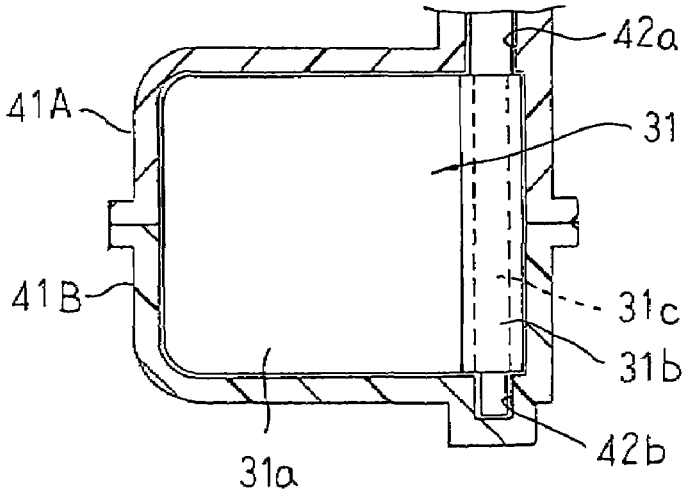
FIG. 13 is a cross section taken along line XIII-XIII in FIG. 10 viewed from the direction of the arrows.

FIG. 10 is a cross section showing an engine air intake apparatus according to Embodiment 6 of the present invention, FIG. 11 is a top plan showing the engine air intake apparatus according to Embodiment 6 of the present invention, and FIG. 12 is a side elevation showing the engine air intake apparatus according to Embodiment 6 of the present invention.

In FIGS. 10 through 13, an air cleaner chamber 20B includes: an air cleaner cover 21 made of a synthetic resin; and an air cleaner case 40 made of a synthetic resin. The air cleaner case 40 includes: a first case segment 41A functioning together with the air cleaner cover 21 so as to hold the filtering member 23; and a second case segment 41B functioning together with the first case segment 41A so as to constitute a high-speed operation air intake passage 25 and a low-speed operation air intake passage 24. Shaft bearing portions 42*a* and 42*b* are formed on the first case segment 41A and the second case segment 41B so as to face each other. A passage switching valve 31 includes: a cylindrical shaft portion 31*b* on which a valve body 31*a* is formed integrally; and a rotating shaft 31*c* press-fitted into the shaft portion 31*b*. Portions of the rotating shaft 31*c* projecting from the shaft portion 31*b* are supported pivotably by the shaft bearing portions 42*a* and 42*b*, respectively.

Moreover, the rest of this embodiment is configured in a similar manner to Embodiment 3 above.

Next, a method for assembling an air intake apparatus 10E configured in this manner will be explained.

First, the first case segment 41A and the second case segment 41B are placed on top of one another such that the portions of the rotating shaft 31*c* projecting from the shaft portion 31*b* are inserted inside the shaft bearing portions 42*a* and 42*b*. Abutted portions between the first case segment 41A and the second case segment 41B are joined and integrated by a method such as welding, snap-fitting, etc. Thus, the passage switching valve 31 is mounted to the first case segment 41A and the second case segment 41B so as to be able to pivot around the rotating shaft 31*c* between a state blocking the high-speed operation air intake passage 25 and a state blocking the low-speed operation air intake passage 24.

Next, the filtering member 23 is held between the air cleaner case 40, formed by joining together and integrating the second case segment 41B and the first case segment 41A, and the air cleaner cover 21, and the air cleaner case 40 and the air cleaner cover 21 are joined together and integrated, completing assembly of the air intake apparatus 10E.

Thus, in Embodiment 6, because the high-speed operation air intake passage 25 also shares a portion (24*a*) of the low-speed operation air intake passage 24, similar effects to those in Embodiment 3 above can be achieved.

Because the air cleaner case 40 includes: a first case segment 41A functioning together with the air cleaner cover 21 so as to hold the filtering member 23; and a second case segment 41B functioning together with the first case segment 41A so as to constitute the high-speed operation air intake passage 25 and the low-speed operation air intake passage 24, and shaft bearing portions 42*a* and 42*b* are formed on the first case segment 41A and the second case segment 41B, assembly of the passage switching valve 31 is simplified, improving assembly of the air intake apparatus 10E.

Moreover, in Embodiment 6 above, the air cleaner case 40 is explained as being divided into two members (segments) that function together to constitute the high-speed operation air intake passage 25 and the low-speed operation air intake passage 24, but the air cleaner case is not limited to being divided into two segments and may also be divided into three or more segments.

Embodiment 7

Figure 14:
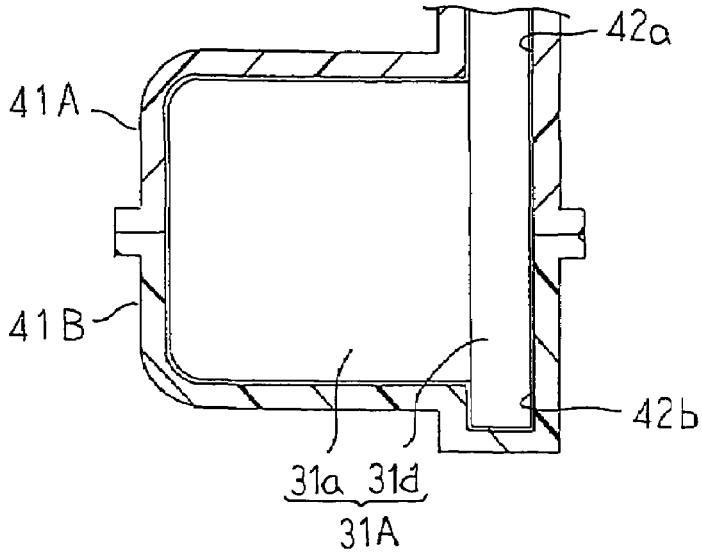
FIG. 14 is a partial cross section showing a vicinity of a passage switching valve in an engine air intake apparatus according to Embodiment 7 of the present invention.

In Embodiment 7, as shown in FIG. 14, a passage switching valve 31A is configured using a synthetic resin such that a valve body 31*a* is formed integrally on a cylindrical rotating shaft 31*d*. First and second end portions of the rotating shaft 31*d* are pivotably supported by shaft bearing portions 42*a* and 42*b*, respectively.

Moreover, the rest of this embodiment is configured in a similar manner to Embodiment 6 above.

Consequently, similar effects to those in Embodiment 6 above can also be achieved in Embodiment 7.

In Embodiment 7, because the passage switching valve 31A is formed such that the valve body 31*a* and the rotating shaft 31*d* are molded integrally using a synthetic resin, the number of parts is reduced, further improving assembly.

Embodiment 8

Figure 15:
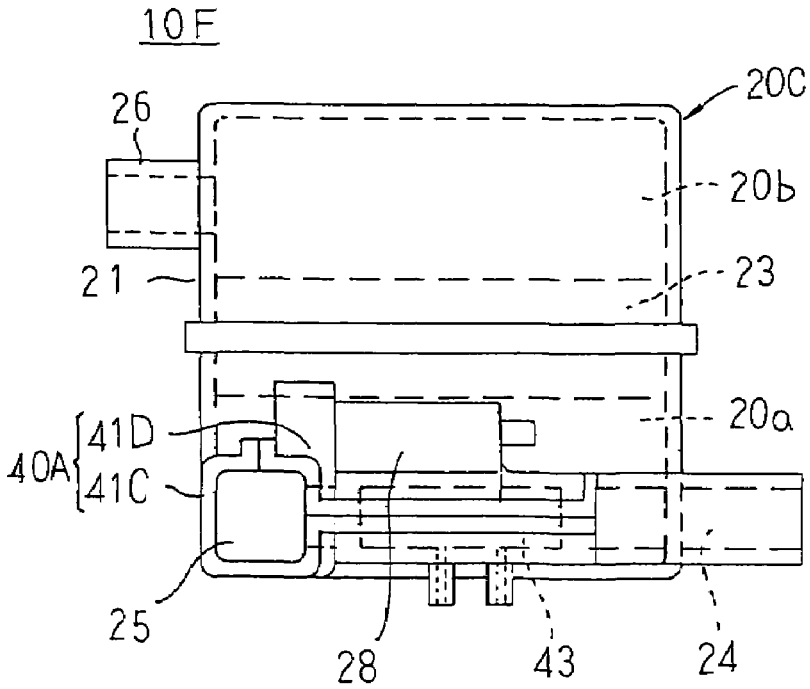
FIG. 15 is a front elevation showing an engine air intake apparatus according to Embodiment 8 of the present invention.
Figure 16:
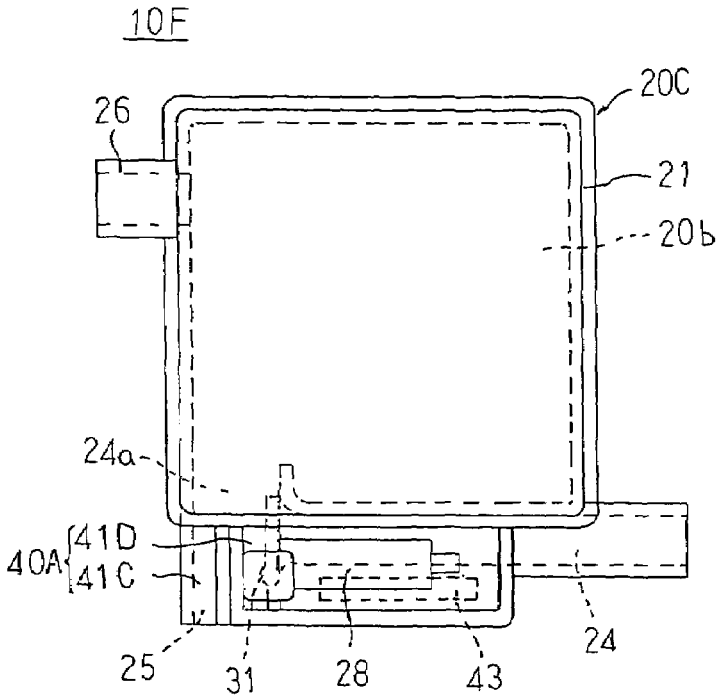
FIG. 16 is a top plan showing the engine air intake apparatus according to Embodiment 8 of the present invention.

FIG. 15 is a cross section showing an engine air intake apparatus according to Embodiment 8 of the present invention, and FIG. 16 is a top plan showing the engine air intake apparatus according to Embodiment 8 of the present invention.

In FIGS. 15 and 16, an air cleaner chamber 20C includes: an air cleaner cover 21 made of a synthetic resin; and an air cleaner case 40A made of a synthetic resin. The air cleaner case 40A is configured so as to be divided into: a first case segment 41C functioning together with the air cleaner cover 21 so as to hold the filtering member 23; and a second case segment 41D functioning together with the first case segment 41C so as to constitute a negative pressure accumulator chamber 43 in addition to a high-speed operation air intake passage 25 and a low-speed operation air intake passage 24.

Moreover, the rest of this embodiment is configured in a similar manner to Embodiment 6 above.

Next, a method for assembling an air intake apparatus 10F configured in this manner will be explained.

First, the first case segment 41C and the second case segment 41D are placed on top of one another so as to constitute the high-speed operation air intake passage 25, the low-speed operation air intake passage 24, and the negative pressure accumulator chamber 43. Abutted portions between the first case segment 41C and the second case segment 41D are joined and integrated gastightly by a method such as welding, etc. Moreover, the passage switching valve 31 is mounted to the first case segment 41C and the second case segment 41D so as to be able to pivot around the rotating shaft 31*c* between a state blocking the high-speed operation air intake passage 25 and a state blocking the low-speed operation air intake passage 24 in a similar manner to Embodiment 6 above.

Next, the filtering member 23 is held between the air cleaner case 40A, formed by joining together and integrating the second case segment 41C and the first case segment 41D, and the air cleaner cover 21, and the air cleaner case 40A and the air cleaner cover 21 are join together and integrated, completing assembly of the air intake apparatus 10F.

Thus, in Embodiment 8, the high-speed operation air intake passage 25 also shares a portion (24*a*) of the low-speed operation air intake passage 24. The air cleaner case 40A includes: a first case segment 41C functioning together with the air cleaner cover 21 so as to hold the filtering member 23; and a second case segment 41D functioning together with the first case segment 41C so as to constitute the high-speed operation air intake passage 25 and the low-speed operation air intake passage 24. Thus, similar effects to those in Embodiment 6 above can also be achieved in Embodiment 8.

According to Embodiment 8, because the negative pressure accumulator chamber 43 is molded integrally on the first case segment 41C and the second case segment 41D, if a negative pressure diaphragm actuator is used for the valve actuator 28, it is not necessary to dispose a separate negative pressure accumulator chamber, enabling the number of parts to be reduced and improving mounting workability. Similarly, even if this air intake apparatus 10F is applied to an airflow control apparatus or a variable air intake apparatus, etc., using a negative pressure diaphragm actuator as an actuator, it is not necessary for a negative pressure accumulator chamber required for the negative pressure diaphragm actuator to be disposed separately.

Embodiment 9

Figure 17:
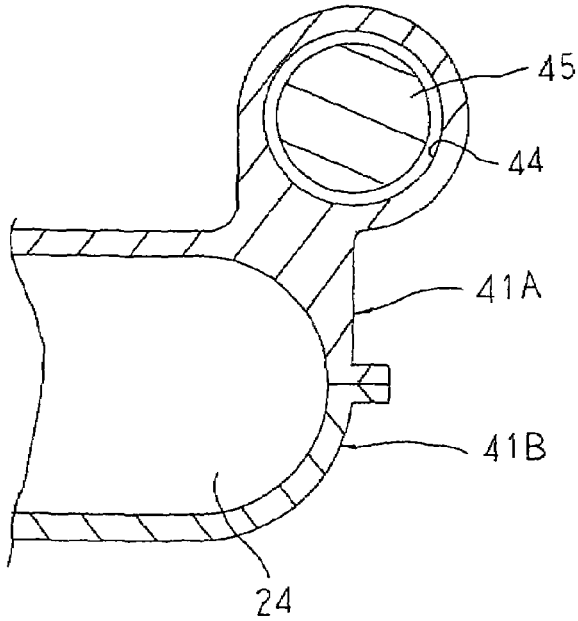
FIG. 17 is a cross section showing part of an air cleaner case in an engine air intake apparatus according to Embodiment 9 of the present invention.

In Embodiment 9, as shown in FIG. 17, the motor case portion 44 is molded integrally on a first case segment 41A.

Moreover, the rest of this embodiment is configured in a similar manner to Embodiment 6 above.

Consequently, similar effects to those in Embodiment 6 above can also be achieved in Embodiment 9.

According to Embodiment 9, because the motor case portion 44 is molded integrally on the first case segment 41A, when an electric motor 45 is used as a valve actuator, the electric motor 45 can be disposed in the motor case portion 44. Thus, it is not necessary for the electric motor 45 to be fixed to the air cleaner case using a screw, etc., enabling the number of parts to be reduced and improving mounting workability.

What is claimed is:

1. An engine air intake apparatus comprising:

a plurality of air intake passages molded integrally on a synthetic resin air cleaner case of an engine air cleaner;

a passage switching valve disposed on said air cleaner case, said passage switching valve switching among said plurality of air intake passages; and a valve actuator for driving said passage switching valve, wherein:

each air intake passage of said plurality of air intake passages is formed so as to have a passage portion shared with at least one other of said air intake passages, and said valve actuator drives said passage switching valve so as to selectively switch among said plurality of air intake passages so as to configure an air intake pathway corresponding to an engine operating state.

2. The engine air intake apparatus according to claim 1, wherein:

at least three of said air intake passages are molded integrally on said air cleaner case; and one of said air intake passages is formed so as to have a passage portion shared with all of a remainder of said air intake passages.

3. The engine air intake apparatus according to claim 1, wherein:

said passage switching valve is a flap valve.

4. The engine air intake apparatus according to claim 3, wherein:

said air cleaner case is configured so as to be divided into a plurality of case segments that combine with each other so as to constitute said plurality of air intake passages; and a rotating shaft of said flap valve is rotatably supported by two case segments among said plurality of case segments.

5. The engine air intake apparatus according to claim 4, wherein:

said flap valve is configured such that a valve body and said rotating shaft are molded integrally using a synthetic resin.

6. The engine air intake apparatus according to claim 1, further comprising a negative pressure accumulator chamber molded integrally on said air cleaner case.

7. The engine air intake apparatus according to claim 1, wherein:

said valve actuator is an electric motor; and a motor case for accommodating said electric motor is molded integrally on said air cleaner case.

* * * * *